US009275577B2

(12) United States Patent
Ma

(10) Patent No.: US 9,275,577 B2
(45) Date of Patent: Mar. 1, 2016

(54) FRAME SCANNING PIXEL DISPLAY DRIVING UNIT AND DRIVING METHOD THEREOF, DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 35 days.

(21) Appl. No.: 14/342,088

(22) PCT Filed: Aug. 14, 2013

(86) PCT No.: PCT/CN2013/081466

§ 371 (c)(1),
(2) Date: Feb. 28, 2014

(87) PCT Pub. No.: WO2014/176843

PCT Pub. Date: Nov. 6, 2014

(65) Prior Publication Data

US 2014/0320473 A1 Oct. 30, 2014

(30) Foreign Application Priority Data

Apr. 28, 2013 (CN) ..... 2013 1 0156336

(51) Int. Cl.
*G09G 3/30* (2006.01)
*G09G 3/32* (2006.01)
*G09G 3/10* (2006.01)

(52) U.S. Cl.
CPC ..... *G09G 3/3233* (2013.01); *G09G 3/3225* (2013.01); *G09G 2300/0819* (2013.01);

(Continued)

(58) Field of Classification Search
CPC ..... G09G 3/3225
USPC ..... 345/76; 315/169.3
See application file for complete search history.

(56) References Cited

U.S. PATENT DOCUMENTS

2010/0245402 A1 * 9/2010 Choi et al. ..... 345/77
2012/0062538 A1 * 3/2012 Koyama ..... 345/76

(Continued)

FOREIGN PATENT DOCUMENTS

CN 102087826 A 6/2011
CN 103021333 A * 4/2013 ..... G09G 3/32
CN 203204996 U 9/2013

OTHER PUBLICATIONS

English abstract of CN203204996U, listed above, 1 page.

(Continued)

*Primary Examiner* — Adam J Snyder
(74) *Attorney, Agent, or Firm* — Ladas & Parry LLP

(57) ABSTRACT

The present disclosure provides a frame scanning pixel display driving unit and a driving method thereof, and a display apparatus. The frame scanning pixel display driving unit includes: a driving control module for receiving a first frame data signal, and controlling the driving transistor to drive the pixel to display based on the first frame data signal; a data writing module for receiving and latch the second frame data signal when the driving transistor drives the pixel to display based on the first frame data signal, and transmitting the second frame data signal to the driving control module after the displaying of the first frame data signal is completed. The present disclosure enables a frame scanning display mode, and can reduce the power consumption during the signal writing phase and effectively reduce the power consumption of the panel display.

15 Claims, 3 Drawing Sheets

(52) U.S. Cl.
CPC ..... *G09G2300/0842* (2013.01); *G09G 2300/0852* (2013.01); *G09G 2300/0861* (2013.01); *G09G 2310/0251* (2013.01)

(56) References Cited

U.S. PATENT DOCUMENTS

| | | | | |
|---|---|---|---|---|
| 2012/0146999 | A1* | 6/2012 | Hwang | 345/76 |
| 2012/0293479 | A1* | 11/2012 | Han | 345/212 |
| 2012/0306840 | A1* | 12/2012 | Han | 345/212 |
| 2014/0139505 | A1* | 5/2014 | Han | 345/212 |

OTHER PUBLICATIONS

English abstract of CN102087826A, listed above, 1 page.
First Office Action (Chinese language) issued by the State Intellectual Property Office ("SIPO") on Aug. 29, 2014 for application No. 201310156336.2, 7 pages.
English translation of first Office Action issued by SIPO for application No. 201310156336.2, listed above, 5 pages.
International Preliminary Report on Patentability issued Nov. 3, 2015; PCT/CN2013/081466.

* cited by examiner

FRAME SCANNING PIXEL DISPLAY DRIVING UNIT AND DRIVING METHOD THEREOF, DISPLAY APPARATUS

CROSS REFERENCE TO RELATED APPLICATIONS

This application is based on International Application No. PCT/CN2013/081466 filed on Aug. 14, 2013, which claims priority to Chinese National Application No. 201310156336.2 filed on Apr. 28, 2013. The entire contents of each and every foregoing application are incorporated herein by reference.

TECHNICAL FIELD

The present disclosure relates to display manufacturing technology, and particularly to a frame scanning pixel display driving unit and a driving method thereof, and a display apparatus.

BACKGROUND

Currently in a field of display technology, a panel displaying is usually implemented by employing a line scanning method. However, the line scanning display method may have a high power consumption and cause a flickering problem in a produced display apparatus. Therefore, in the prior art, a liquid crystal display (LCD) may use a new frame scanning control method to implement the display.

However, a technique for the current LCDs that employ the frame scanning control method has not yet been maturely researched, and has defects such as complicated structures. For example, thin film transistors (TFTs) for controlling light-emitting of pixels are in a turned off state so that the light-emitting elements cannot emit light all the while when signals are written in; and the TFTs can be turned on only after all the signals for a frame have been written in. Therefore, for a frame, most of the time is spent on a signal writing-in phase, so there is only a little time for the actual light-emitting, and accordingly the panel display is negatively affected and the power consumption is not reduced significantly.

SUMMARY

Technical solutions of the present disclosure are directed to a frame scanning pixel display driving unit, a driving method thereof and a display apparatus which are configured to display in a frame scanning manner and may reduce the power consumption during the signal writing phase, and thus may effectively reduce the power consumption of the panel display.

The present disclosure provides a frame scanning pixel display driving unit, which comprises a driving transistor for driving a pixel to display, a data writing module and a driving control module, wherein:

the driving control module is configured to: receive a first frame data signal which is transmitted from the data writing module, and control the driving transistor to drive the pixel to display based on the first frame data signal; and the data writing module is configured to: receive and latch a second frame data signal when the driving transistor drives the pixel to display based on the first frame data signal, and transmit the second frame data signal to the driving control module after the displaying of the first frame data signal is completed;

wherein, the second frame data signal is a data signal of a frame next to the first frame data signal.

Preferably, in the above-described frame scanning pixel display driving unit, the driving control module comprises:

a first light-emitting control sub-module, configured to receive the second frame data signal from the data writing module, and to connect a gate and a drain of the driving transistor after the displaying of the pixel is completed, so that the driving transistor is connected in a diode mode;

a second light-emitting control sub-module, configured to connect the driving transistor with a light-emitting element when the driving transistor drives the pixel to display, and to disconnect the driving transistor from the light-emitting element after the displaying of the pixel is completed;

a first adjusting sub-module, configured to provide a source and the gate of the driving transistor with voltage signals enabling to turn on the driving transistor when the driving transistor drives the pixel to display, and to disconnect the voltage signals from the source and gate of the driving transistor, respectively, when the displaying of the pixel is completed; and a second adjusting sub-module, configured to pull down a potential at a connection node between the data writing module and the first light-emitting control sub-module to prepare for the transmission of the second frame data signal to the first light-emitting control sub-module, before the data writing module transmits the second frame data signal to the first light-emitting control sub-module.

Preferably, in the frame scanning pixel display driving unit as described above, the first adjusting sub-module, in response to a first control signal, makes the first light-emitting control sub-module to enter a first phase during which the driving transistor is driven to make the pixel to display based on the first frame data signal; the data writing module, in response to a fourth control signal, enters the first phase to receive and latch the second frame data signal; the second light-emitting control sub-module, in response to the first control signal, enters the first phase to connect the driving transistor with the light-emitting element;

the second adjusting sub-module, in response to a third control signal, enters a second phase during which the potential at the connection node between the data writing module and the first light-emitting control sub-module is pulled down;

the data writing module, in response to the second control signal, enters a third phase during which the second frame data signal is transmitted to the driving control module; and the first light-emitting control sub-module, in response to the second control signal, enters the third phase to disconnect the gate of the driving transistor from the drain of the driving transistor, and the first adjusting sub-module, in response to the second control signal, disconnects the voltage signals enabling to turn on the driving transistor from the source and the gate of the driving transistor, respectively.

Preferably, in the above-described frame scanning pixel display driving unit, the first light-emitting control sub-module comprises:

a first capacitor, wherein a first terminal of the first capacitor is connected with the gate of the driving transistor, a second terminal of the first capacitor is connected with an output terminal of the data writing module; and a second switching transistor, wherein a gate of the second switching transistor is connected with the second control signal, a source of the second switching transistor is connected with the gate of the driving transistor, and a drain of the second switching transistor is connected with the drain of the driving transistor.

Preferably, in the above described frame scanning pixel display driving unit, the second light-emitting control sub-module comprises: a third switching transistor, wherein a gate of the third switching transistor is connected with the first control signal, a source of the third switching transistor is connected with the drain of the driving transistor, and a drain of the third switching transistor is connected with the light-emitting element, and wherein one terminal of the light-emitting element is connected with a first voltage signal terminal.

Preferably, in the above-described frame scanning pixel display driving unit, the data writing module comprises:

a fifth switching transistor, wherein a gate of the fifth switching transistor is connected with the second control signal, and a drain of the fifth switching transistor, which is the output terminal of the data writing module, is connected with the first light-emitting control sub-module;

a second capacitor, wherein a first terminal of the second capacitor is connected with a source of the fifth switching transistor, and a second terminal of the second capacitor is connected with the third voltage signal terminal;

a fourth switching transistor, wherein a gate of the fourth switching transistor is connected with the fourth control signal, a source of the fourth switching transistor is connected with a data signal terminal, and a drain of the fourth switching transistor is connected with a common connection terminal A between the second capacitor and the fifth switching transistor.

Preferably, in the above-described frame scanning pixel display driving unit, the first adjusting sub-module comprises:

a sixth switching transistor, wherein a source of the sixth switching transistor is connected with a third voltage signal terminal, a drain of the sixth switching transistor is connected with the source of the driving transistor, and a gate of the sixth switching transistor is connected with the second control signal;

a seventh switching transistor, wherein a source of the seventh switching transistor is connected with a second voltage signal terminal, a drain of the seventh switching transistor is connected with the drain of the sixth switching transistor, and a gate of the seventh switching transistor is connected with the first control signal;

a eighth switching transistor, wherein a source of the eighth switching transistor is connected with the second voltage signal terminal, a drain of the eighth switching transistor is connected with a common connecting terminal 13 between the data writing module and the first light-emitting control sub-module, and a gate of the eighth switching transistor is connected with the first control signal.

Preferably, in the above-described frame scanning pixel display driving unit, the second adjusting sub-module comprises:

a ninth switching transistor, wherein a source of the ninth switching transistor is connected with the third voltage signal terminal, a drain of the ninth switching transistor is connected with the output terminal of the data writing module, and a gate of the ninth switching transistor is connected with the third control signal.

Preferably, in the above-described frame scanning pixel display driving unit, the fourth control signal is a gate scanning signal, and the second phase is entered after all of the first phases for each row of pixel units have been completed.

Preferably, in the above-described frame scanning pixel display driving unit, the first adjusting sub-module and the second adjusting sub-module are connected with a column of pixel units correspondingly.

Preferably, in the above-described frame scanning pixel display driving unit, the third voltage signal terminal is connected to ground.

Preferably, in the above-described frame scanning pixel display driving unit, the driving transistor and the transistors in the frame scanning pixel display driving unit are P-type film field effect transistors; and during the first phase, the first control signal and the fourth control signal are at a low level, and the second control signal and the third control signal are at a high level; during the second phase, the third control signal is at the low level, and the first control signal, the second control signal and the fourth control signal are at a high level; and during the third phase, the first control signal, the third control signal and the fourth control signal are at the high level, and the second control signal is at the low level.

The present disclosure also provides a display apparatus which comprises the above-described frame scanning pixel display driving unit.

In addition, the present disclosure also provides a driving method for the above-described frame scanning pixel display driving unit, and the driving method include:

during a first phase, controlling, by the driving control module according to the first frame data signal transmitted from the data writing module, the driving transistor to drive the pixel to display based on the first frame data signal; and meanwhile receiving and latching, by the data writing module, the second frame data signal;

during a third phase, transmitting, by the data writing module, the second frame data signal to the driving control module.

Preferably, the above-described driving method further comprises:

a second phase which is between the first phase and the third phase, during which a potential at a connection node between the data writing module and the driving control module is pulled down to prepare for the transmission of the second frame data signal to the driving control module.

At least one of the above technical solutions of the detailed embodiments of the present disclosure has the following advantageous effects:

By using the frame scanning pixel display driving unit, a display pixel may be in a process for writing a data signal of a next frame when the display pixel receives a data signal of a previous frame to display, thus the time for light emitting of the light-emitting element can be significantly increased, and the display effect can be improved; meanwhile, the power consumption of the display apparatus during the signal writing phase can be reduced, so the power consumption of the panel display can be effectively reduced; on the other hand, a function for compensating the IR Drop of the power source voltage drop of $V_{TH}$ and $V_{DD}$ can be achieved so that the display effect can be further improved.

DETAILED DESCRIPTION

Objects, solutions and advantages of the present disclosure will be more apparent from the following detailed description taken in conjunction with the accompanying drawings and the detailed embodiments.

A frame scanning pixel display driving unit according to the detailed embodiments of the present disclosure includes a driving transistor for driving a pixel to display, a data writing module and a driving control module, wherein:

the driving control module is configured to: receive a first frame data signal transmitted from the data writing module, and control the driving transistor to drive the pixel to display based on the first frame data signal; and the data writing module is configured to: receive and latch a second frame data signal when the driving transistor drives the pixel to display based on the first frame data signal, and transmit the second frame data signal to the driving control module after the displaying of the first frame data signal is completed;

wherein the second frame data signal is a data signal of a frame next to the first frame data signal.

The present embodiment is described by taking a light-emitting pixel display driving circuit as an example, but the present disclosure is not limited to such type of display device. Any display device having a pixel display driving unit can employ the technical solutions provided by the present disclosure to resolve the above-described technical problems and achieve corresponding technical effects.

Figure 1:
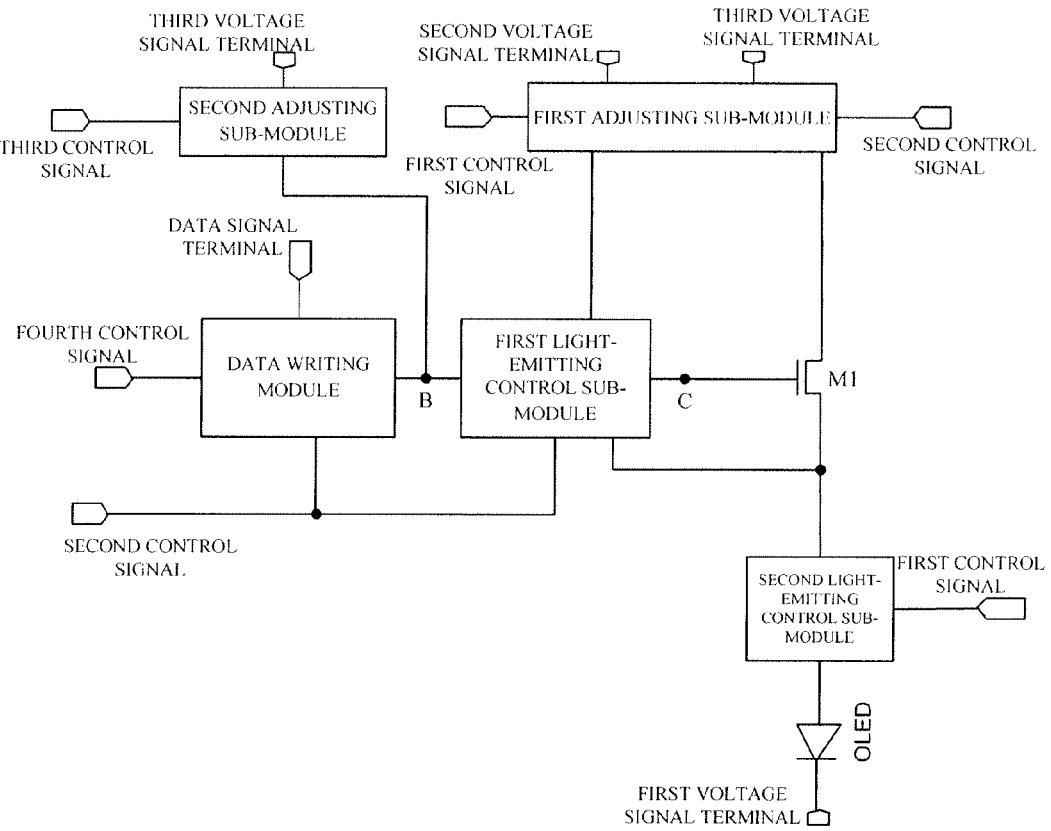
FIG. 1 illustrates a schematic diagram of the frame scanning pixel display driving unit according to detailed embodiments of the present disclosure.

FIG. 1 is a schematic diagram of the frame scanning display circuit according to detailed embodiments of the present disclosure. As illustrated in FIG. 1, the driving control module specifically comprises:

a first light-emitting control sub-module, configured to receive the second frame data signal from the data writing module, and to connect the gate and the drain of the driving transistor after the displaying of the pixel is completed so that the driving transistor is connected in a diode mode;

a second light-emitting control sub-module, configured to connect the driving transistor with a light-emitting element when the driving transistor drives the pixel to display, and to disconnect the driving transistor from the light-emitting element after the displaying of the pixel is completed;

a first adjusting sub-module, configured to provide a source and a gate of the driving transistor with voltage signals enabling to turn on the driving transistor when the driving transistor drives the pixel to display, and to disconnect the voltage signals from the source and the gate of the driving transistor, respectively, when the displaying of the pixel is completed; and a second adjusting sub-module, configured to pull down a potential at a connection node between the data writing module and the first light-emitting control sub-module to prepare for the transmission of the second frame data signal to the first light-emitting control sub-module, before the data writing module transmits the second frame data signal to the first light-emitting control sub-module.

In one example, the first adjusting sub-module, in response to a first control signal, makes the first light-emitting control sub-module to enter a first phase during which the driving transistor is driven to make the pixel to display based on the first frame data signal; the data writing module, in response to a fourth control signal, enters into the first phase to receive and latch the second frame data signal; the second light-emitting control sub-module, in response to the first control signal, enters into the first phase to connect the driving transistor with the light-emitting element;

the second adjusting sub-module, in response to a third control signal, enters into a second phase during which the potential at the connection node between the data writing module and the first light-emitting control sub-module is pulled down; and the data writing module, in response to the second control signal, enters a third phase during which the second frame data signal is transmitted to the driving control module; and the first light-emitting control sub-module, in response to the second control sub-module, enters the third phase to disconnect the gate of the driving transistor from the drain of the driving transistor, and the first adjusting sub-module, in response to the second control signal, disconnects the voltage signals enabling to turn on the driving transistor from the source and gate of the driving transistor, respectively.

As described above, for one example of the first light-emitting control sub-module, a first input terminal is connected with an output terminal of the data writing module, and its two output terminals are connected with the gate and the drain of the driving transistor, respectively; the first light-emitting control sub-module is configured to, disconnect or connect the gate and the drain of the driving transistor in response to the second control signal; in addition, one of the output terminals of the second adjusting sub-module is connected with a connection terminal B between the data writing module and the first light-emitting control sub-module.

In an example, the second light-emitting control sub-module is disposed between the light-emitting element and the driving transistor, and is configured to disconnect or connect the driving transistor and the light-emitting element in response to the first control signal.

In an example, as for the first adjusting sub-module, two input terminals of the first adjusting sub-module are connected with the second voltage signal terminal and the third voltage signal terminal, respectively. The first adjusting sub-module is configured to connect or disconnect a first output terminal of the first adjusting sub-module and the second voltage signal terminal in response to the first control signal and/or the second control signal, and to connect a second output terminal of the first adjusting sub-module with the second voltage signal terminal or with the third voltage signal terminal in response to the first control signal and/or the second control signal. Wherein the source of the driving transistor is connected with the second output terminal of the first adjusting sub-module, and the light-emitting element is connected with the first voltage signal terminal.

In an example, as for the second adjusting sub-module, an input terminal of the second adjusting sub-module is connected with the third voltage signal terminal, an output terminal of second adjusting sub-module is connected with the connection node B, and the second adjusting sub-module is configured to disconnect or connect the connection node B and the third voltage signal terminal in response to the third control signal.

In the present embodiment, it is merely a preferred embodiment to divide the driving control module into the first and the second light-emitting control sub-modules and the first and the second adjusting sub-modules, and the present embodiment is not limited thereto. Those skilled in the related art may modify the driving control module into other forms. For example, the driving control module may not include two adjusting sub-modules, but may be implemented by incorporating the functions of the adjusting sub-modules into the data writing module; or, transistor devices having additional functions can be added to the driving control module to achieve functions such as stabilization control or noise current reduction; or, the connection order of the elements can be changed reasonably. All the modifications are within the protection scope of the disclosure. Similarly, the detailed implementation of the data writing module is merely a preferred embodiment, and the covered circuit connection structures are not limited thereto.

In one example, during the first phase, the first adjusting sub-module responds to the first control signal, the source of the driving transistor is connected with the second voltage signal terminal, and the connection node B between the data writing module and the first light-emitting control sub-module is connected with the second voltage signal terminal; during the third phase, the first adjusting sub-module responds to the second control signal, the source of the driving transistor is connected with a third voltage signal, and the connection node B is disconnected from the second voltage signal terminal.

In an example, one terminal of the light-emitting element is connected with the first voltage signal terminal, and in the first phase, the driving transistor and the light-emitting element are disposed between the second voltage signal terminal and the first voltage signal terminal, the driving transistor is turned on, and the light-emitting element is in a state of emitting light based on the first frame data signal.

By employing the above-described frame scanning pixel display driving unit, the frame scanning mode can be realized, and when the data writing module loads and latches a potential of the second frame data signal output from the data signal terminal to an internal node in response to the fourth control signal, the first adjusting sub-module connects the first output terminal of the first adjusting sub-module and the second voltage signal terminal in response to the first control signal; the first light-emitting control sub-module disconnects the gate of the driving transistor from the drain of the driving transistor in response to the second control signal; and the second light-emitting control sub-module connects the driving transistor with the light-emitting element in response to the first control signal to make the light-emitting element emit light. As such, the light-emitting element maintains to emit light during the data loading phase, thus the time for light-emitting can be increased, and the display effect of the display apparatus can be significantly improved. On the other hand, the power consumption of the display apparatus during the signal writing phase can be reduced, and thus the power consumption of the panel display can be effectively reduced.

In one example, the frame scanning pixel display driving unit relates to following three operation phases, in which:

during the first phase, the data writing module loads and latches a potential of the data signal output from the data signal terminal to a internal node in response to the fourth control signal; at the same time the first adjusting sub-module connects the first output terminal of the first adjusting sub-module with the second voltage signal terminal in response to the first control signal and/or the second control signal; the first light-emitting control sub-module disconnects the gate of the driving transistor from the drain of the driving transistor in response to the second control signal; the second light-emitting control sub-module connects the driving transistor with the light-emitting element in response to the first control signal, the light-emitting element emits light;

during the second phase, the second adjusting sub-module responds to the third control signal, the output terminal of the second adjusting sub-module is connected with the third voltage signal terminal, so that a voltage between the data writing module and a common connecting terminal of the first light-emitting control sub-module is equal to a voltage of the third voltage signal terminal; and during the third phase, the data writing module is connected with the first light-emitting control sub-module in response to the second control signal so as to transmit a potential of the data signal internally latched to the first light-emitting control sub-module; the first light-emitting control sub-module connects the gate and the drain of the driving transistor in response to the second control signal; meanwhile the first adjusting sub-module connects the second output terminal of the first adjusting sub-module with the second voltage signal terminal in response to the second control signal so that the light-emitting element does not emit light.

In an example, during the first phase, the first control signal and the fourth control signal are activated, and the second control signal and the third control signal are deactivated; during the second phase, the third control signal is activated, and the first control signal, the second control signal and the fourth control signal are deactivated; during the third phase, the first control signal, the third control signal and the fourth control signal are deactivated, and the second control signal is activated.

In addition, the fourth control signal is a gate scanning signal, and the frame scanning display circuit includes multiple rows of the pixel units, and the second phase is entered after all of the first phases for each row of the pixel units have been completed. Furthermore, the frame scanning display circuit includes multiple columns of the pixel units, and each of the adjusting units is connected with one column of the pixel units correspondingly, therefore technicals effect of reducing the number of the data lines of the pixel circuit and further simplifying the pixel structure can be achieved.

In one example, the third voltage signal terminal is connected to ground, i.e., an output voltage of the third voltage signal terminal is zero. Hereinafter the specific circuit structure of the frame scanning pixel display driving unit according to the detailed embodiments of the present disclosure will be described in more detail by referring to FIG. 2.

Figure 2:
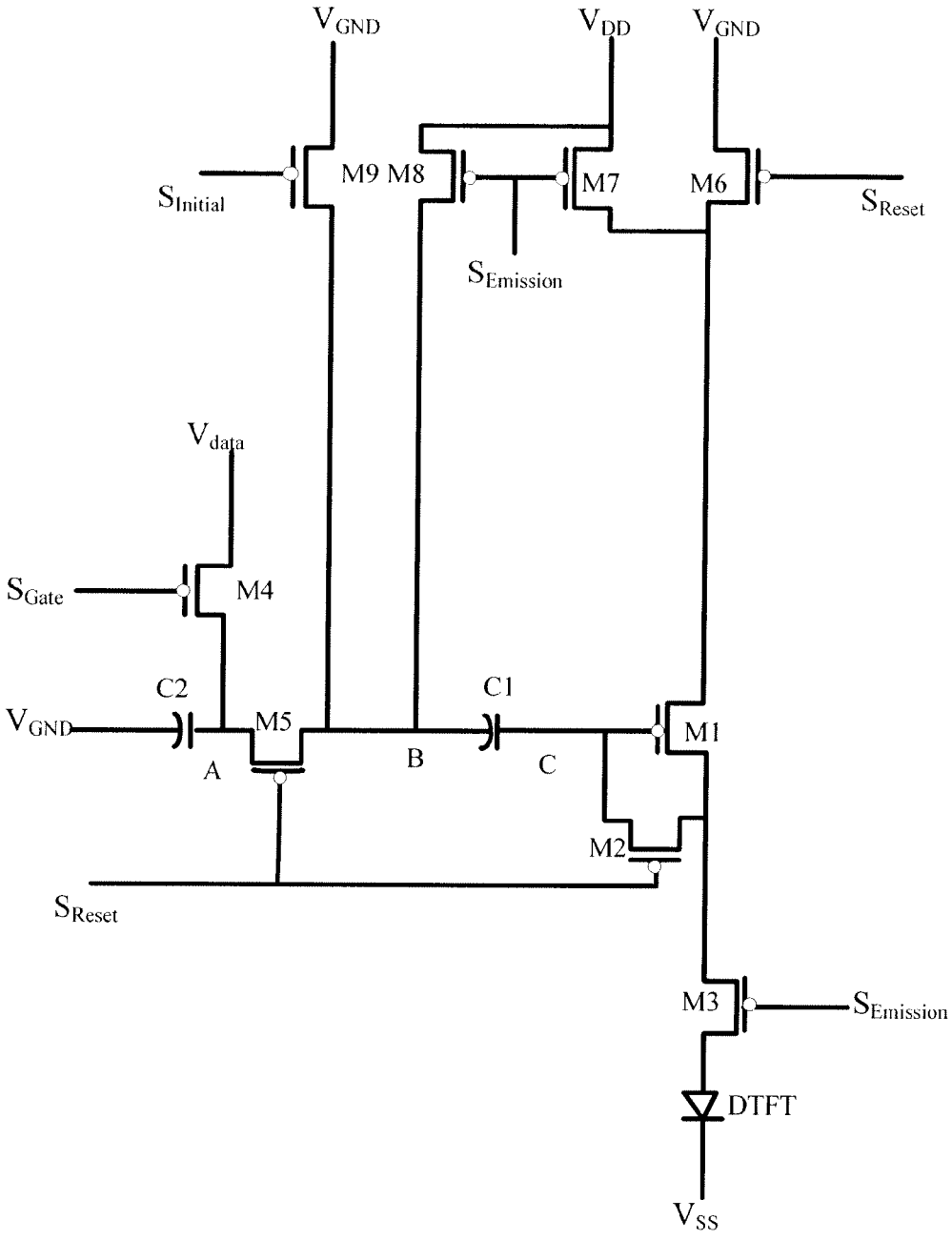
FIG. 2 illustrates a structural diagram of the frame scanning pixel display driving unit according to detailed embodiments of the present disclosure.

Referring to FIG. 2, a circuit structure of a pixel according to the present embodiment includes 9 thin film field effect transistors (TFTs) and 2 capacitors C, wherein a driving transistor M1, a second switching transistor M2, a third switching transistor M3, a fourth switching transistor M4, a fifth switching transistor M5, a sixth switching transistor M6, a seventh switching transistor M7, a eighth switching transistor M8 and a ninth switching transistor M9 are respectively P-type field effect transistors. In the following description, a source and a drain of the driving transistor M1 are defined by a flowing direction of a reference current, i.e., an electrode at which the current flows in is the source, and the electrode at which the current flows out is the drain. As for each of the switching transistors M2 to M9, when one of electrodes is a source, the other one is a drain.

In addition, in the present embodiment, $V_{data}$ denotes a data signal terminal, $V_{SS}$ denotes a first voltage signal terminal, $V_{DD}$ denotes a second voltage signal terminal, $V_{GND}$ denotes a third voltage signal terminal, wherein the $V_{GND}$ connects to the ground, i.e., an output voltage of the $V_{GND}$ is zero. On the other hand, a first control signal, a second control signal, a third control signal and a fourth control signal are respectively denoted by $S_{Emission}$, $S_{Reset}$, $S_{Initial}$ & and $S_{Gate}$.

As illustrated in FIG. 2, in one example of the frame scanning display circuit according to the present embodiment, the first light-emitting control sub-module comprises:

a first capacitor C1, disposed between the data writing module and the gate of the driving transistor M1; in the present embodiment, one electrode of the first capacitor C1 is connected with the gate of the driving transistor M1, and the other electrode of the first capacitor C1 is connected with the fifth switching transistor M5 in the data writing module;

the second switching transistor M2, wherein a source and a drain of the second switching transistor M2 are connected with the gate and drain of the driving transistor, respectively, and a gate of the second switching transistor M2 is connected with the control signal $S_{Reset}$; and the second switching transistor M2 is configured to connect or disconnect the gate and the drain of the driving transistor M1 in response to the control signal $S_{Reset}$.

In one example, the second light-emitting control sub-module comprises:

the third switching transistor M3, wherein a source of the third switching transistor M3 is connected with the drain of the driving transistor M1, a drain of the third switching transistor M3 is connected with a light-emitting element D1, and a gate of the third switching transistor M3 is connected with a control signal $S_{Emission}$; the third switching transistor M3 is configured to disconnect or connect the driving transistor M1 and the light-emitting element D1 in response to the control signal $S_{Emission}$.

In one example, the data writing module comprises:

a second capacitor C2 and the fifth switching transistor M5 which are sequentially connected in series between the $V_{GND}$ and the first light-emitting control sub-module, i.e., a source of the fifth switching transistor M5 is connected with the second capacitor C2, a drain of the fifth switching transistor M5 is connected with the first capacitor C1, wherein a gate of the fifth switching transistor M5 is connected with the control signal $S_{Reset}$;

the fourth switching transistor M4, wherein a gate of the fourth switching transistor M4 is connected with the control signal $S_{Gate}$, a source of the fourth switching transistor M4 is connected with the data signal terminal $V_{data}$, and a drain of the fourth switching transistor M4 is connected with a common connection terminal A between the second capacitor C2 and the fifth switching transistor M5;

wherein, the fourth switching transistor M4 is configured to load a potential of a data signal output from the data signal terminal $V_{data}$ to the point A in response to the control signal $S_{Gate}$; the fifth switching transistor M5 is configured to latch a potential at the common connection terminal A between the second capacitor C2 and the fifth switching transistor M5, or transmit the same to the first light-emitting control sub-module, i.e., to the first capacitor C1, in response to the control signal $S_{Reset}$.

In one example, a first adjusting sub-module comprises:

the sixth switching transistor M6, wherein a source of the sixth switching transistor M6 is connected with the third voltage signal terminal $V_{GND}$, a drain of the sixth switching transistor M6 is connected with the source of the driving transistor M1, and a gate of the sixth switching transistor M6 is connected with the control signal $S_{Reset}$;

the seventh switching transistor M7, wherein a source of the seventh switching transistor M7 is connected with the second voltage signal terminal $V_{DD}$, a drain of the seventh switching transistor M7 is connected with the drain of the sixth switching transistor M6, and a gate of the seventh switching transistor M7 is connected with the control signal $S_{Emission}$; and the eighth switching transistor M8, a source of the eighth switching transistor M8 is connected with the second voltage signal terminal $V_{DD}$, a drain of the eighth switching transistor M8 is connected with a common connection terminal between the data writing module and the first light-emitting control sub-module; in the present embodiment, the drain of the eighth switching transistor M8 is connected with a common connection terminal B between the fifth switching transistor M5 and the first capacitor C1, and a gate of the eighth switching transistor M8 is connected with the control signal $S_{Emission}$;

The eighth switching transistor M8 may, in response to the control signal $S_{Emission}$, connected the second voltage signal terminal $V_{DD}$ with the point B to make a magnitude of a voltage at the point B to be equal to a magnitude of a voltage at the second voltage signal terminal $V_{DD}$; the sixth and seventh switching transistors M6 and M7 may, in response to the control signal $S_{Reset}$ and the control signal $S_{Emission}$, make a voltage at the source of the driving transistor M1 to be equal to a magnitude of a voltage at the second voltage signal terminal $V_{DD}$ or to be equal to a magnitude of a voltage at the third voltage signal terminal $V_{GND}$.

Figure 3:
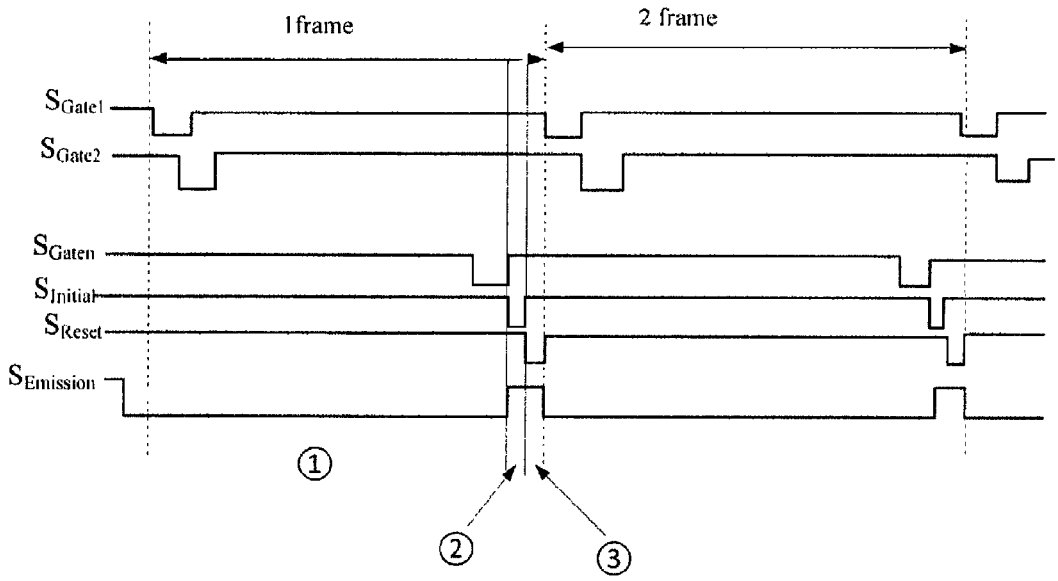
FIG. 3 illustrates a timing diagram of the frame scanning pixel display driving unit according to detailed embodiments of the present disclosure.
Figure 4:
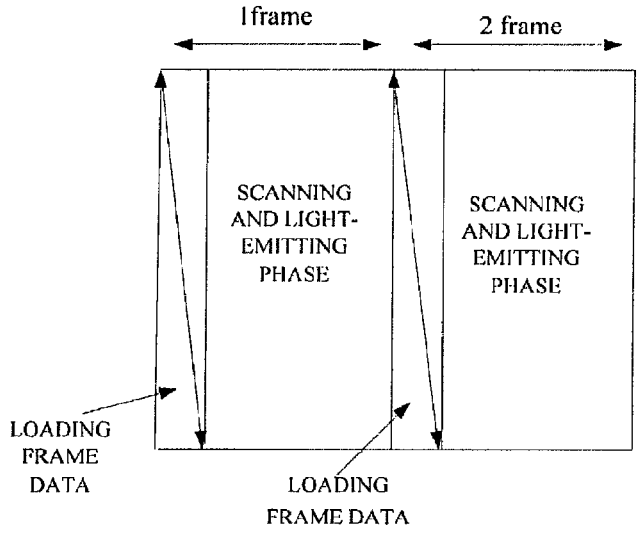
FIG. 4 illustrates a light-emitting timing diagram of the frame scanning pixel display driving unit according to detailed embodiments of the present disclosure.

FIG. 2 has illustrated a detailed embodiment of the frame scanning display circuit. FIG. 3 illustrates a timing diagram of the display circuit, wherein the specific timing of the operations for inputting and displaying a frame of signals can be divided into three phases, and wherein $S_{Gate1}$, $S_{Gate2}$, . . . , $S_{Gaten}$, denotes gate scanning signals of the 1st row, the 2nd row, . . . , the nth row, respectively. FIG. 4 is a light-emitting timing diagram of a light-emitting element which employs the display circuit.

Hereinafter, the specific operation process of the frame scanning display circuit according to the detailed embodiment of the present disclosure will be described in conjunction with FIGS. 3 and 4.

In the phase ①, which is a phase during which light is emitted based on signals of a previous frame, data of each row is written into the common connection terminal A between the second capacitor C2 and the fifth switching transistor M5. Wherein the control signals $S_{Emission}$, and $S_{Gate}$ are activated, and the control signals $S_{Reset}$ and $S_{Initial}$ are deactivated.

In one example, the control signal $S_{Emission}$ can be a light-emitting control signal for controlling the light-emitting of the pixel.

Now charging for pixels in the first row is taken as an example. In the first phase, a potential at point C of the gate of the driving transistor M1 is a signal associated with data of a previous frame for the driving transistor M1, meanwhile the control signal $S_{Emission}$ is activated, and thus the data signal of the previous frame controls the driving transistor M1 to enable displaying. At the same time, since the $S_{Reset}$ is in a deactivated state, the second and fifth switching transistors M2 and M5 are in a turned-off state, and thus a change of the potential at the signal latching point A may not affect the potential at the point B. At this time the control signal $S_{Gate}$ is activated to turn on the fourth switching transistor M4, so that a new data signal is loaded to the latching point A through the data signal terminal $V_{data}$. Meanwhile the seventh switching transistor M7 and the eighth switching transistor M8 in the first adjusting sub-module are turned on to make the potential at the point B to be equal to the voltage at the second voltage signal terminal $V_{DD}$. Thus the source of the driving transistor M1 has a voltage equal to that at the second voltage signal terminal $V_{DD}$, and thus the light-emitting of the light-emitting element OLED is enabled.

after the operations for charging the pixel units of the first row are completed as described above, and then when the second row is being charged, the control signal $S_{Gate}$ for the second row is activated to turn on all the fourth switching transistors M4 on the second row and load data signals of each column to corresponding latching points A, so that the operations for charging the second row can be completed. The above operations are repeated until the operations with respect to the last row, i.e., the nth row, are completed, and then the charging for the entire frame is completed. After that, the signal $S_{Reset}$ is activated. The signal $S_{Reset}$ controls all the pixels and enables the full screen to be frame inversed.

The phase ② is a phase for resetting the Node B. During this phase, the control signals $S_{Emission}$, $S_{Gate}$ and $S_{Reset}$ are all in the deactivated state, and only the control signal $S_{Initial}$ is in the activated state; the ninth switching transistor is turned on in response to the control signal $S_{Initial}$ to make the common connection terminal point B between the first capacitor C1 and the fifth switching transistor M5 (the point B has the potential of one plate of the first capacitor C1) to be connected with the third voltage signal terminal $V_{GND}$; since the $V_{GND}$ is connected to the ground, the potential at the point B is pulled down to zero. Therefore, in this embodiment, the control signal $S_{initial}$ is a frame initializing signal for resetting certain potentials to a same initializing signal before a data signal of each frame is written into; when said control signal is activated, the points B in all the pixels of the panel are pulled down.

During the phase ③, a data signal of the current frame is input to the gate of the driving transistor M1, and the light-emitting element OLED is in a turned off state. During this phase, the control signal $S_{Reset}$ is activated, and the control signals $S_{Emission}$, $S_{Gate}$ and $S_{Initial}$ are deactivated. Therefore, in the present embodiment, the control signal $S_{Reset}$ is a frame reversion control signal, so that the light-emitting element OLED may not be affected when the new data signal is written to the gate of the driving transistor M1.

When the control signal $S_{Reset}$ is activated, the second switching transistor M2 and the sixth switching transistor M6 of the adjusting unit are turned on; upon the sixth switching transistor M6 is turned on, the voltage signal of the third voltage signal terminal $V_{GND}$ is transmitted to the source of the driving transistor M1; meanwhile the second switching transistor M2 is turned on so that the driving transistor M1 is connected in a diode mode, thus its drain has a voltage drop reduction of $V_{TH}$ with respect to its source, and accordingly a potential at point C of the driving transistor becomes $V_{GND}+V_{TH}$ ($V_{TH}$ is a negative value for the P-type thin film transistor); at the same time, the fifth switching transistor M5 is turned on to transmit the data signal latched at point A to point B. Thus, the potential at point B is $V_{Data}$, and the voltage difference across the first capacitor C1 is $V_{Data}+V_{TH}$.

After the above processes, the control signal $S_{Reset}$ is deactivated, upon which signals of the next frame start to be written in, and the process of the first phase is repeated. And upon the control signal $S_{Emission}$ is activated, the potential at the point B of the first capacitor C1 becomes $V_{DD}$, and thus the potential at point C, i.e., at the gate of the driving transistor M1 becomes $V_{DD}+V_{Data}+V_{TH}$ due to the principle of capacitance conservation. At this time, since the seventh and the eighth switching transistors are turned on, the potential at the source of the driving transistor M1 is $V_{DD}$, and since the driving transistor M1 is in a saturation region, its drain-source current can be expressed by the following formula:

$$\begin{aligned} I_{ds} &= \frac{1}{2}\times k\times(V_{gs}-V_{TH})^2 \\ &= \frac{1}{2}\times k\times(V_{DD}+V_{Date}+V_{th}-V_{DD}-V_{TH})^2 \\ &= \frac{1}{2}\times k\times V_{Date}^2. \end{aligned}$$

Wherein, $V_{gs}$ indicates a gate-source voltage of the driving transistor M1, and k=(W/L)×C×u, in which W denotes a width of the transistor, L denotes a length of the transistor, C denotes the capacitance of the transistor, u denotes a carrier mobility of a channel of the transistor; and the respective values are relatively stable for a same structure, thus k is a constant.

It can be seen from the above description that the current flowing through the light-emitting element OLED at this time is merely related to the data signal, and is irrelevant to the threshold voltage $V_{TH}$ of the driving transistor and the voltage $V_{DD}$ at the second voltage signal terminal, thus the IR Drop of the power source voltage drop of $V_{TH}$ and $V_{DD}$ can be compensated, and the display effect can be improved.

In the above frame scanning display circuit, the driving transistor M1 and the switching transistors M2 to M9 are respectively P-type film field effect transistor, therefore each of the control signals $S_{Emission}$, $S_{Gate}$, $S_{Reset}$ and $S_{initial}$ as described above is activated at a potential which is lower than the potential at which the corresponding control signal is deactivated.

In addition, the frame scanning pixel display driving unit, the first adjusting sub-module and the second adjusting sub-module can be disposed on a glass substrate of the display apparatus by using the backboard process technology, or can be integrated into a data IC.

In one example, the frame scanning display circuit includes multiple columns of pixel units.

In one example, the first adjusting sub-module and the second adjusting sub-module are connected with one column of the pixel units correspondingly, thus the technical effects of reducing the number of the data lines of the display circuit and further simplifying the pixel structure can be achieved.

As described above, in the frame scanning pixel display driving unit according to the detailed embodiments of the present disclosure, the light-emitting control sub-module in the pixel region and the adjusting sub-module in the common region can cooperate with each other to not only realize the frame scanning but also enter a process for writing signals of a next frame at the time when the light-emitting elements emit light by receiving data of a current frame, as illustrated in FIG. 4. Therefore, the light-emitting time of the light-emitting elements can be significantly increased, and the display effect can be improved. Meanwhile, the power consumption of the display apparatus during the signal writing phase can be reduced, and accordingly the power consumption of the display panel can be effectively reduced. On the other hand, a function of compensating the IR Drop of the power source voltage drop of $V_{TH}$ and $V_{DD}$ can be realized to further improve the display effect.

The detailed circuit structure of the frame scanning pixel display driving unit as illustrated in FIG. 2 is merely a preferred implementation of the embodiments of the present disclosure, and is not intended to limit the technical solutions thereof. The present disclosure may cover a plurality of implementations other than the specific connection structure as described above, including equivalents and modifications to the above-described structure. For example, one or more transistor devices with one or more terminals connected to ground can be connected at the position of the driving transistor and/or the driving node, so that a noise current can be released when a low level signal is output and the driving voltage can be stabilized when a high level signal is output; or the connection order and/or connection nodes of the elements can be reasonably changed without changing the entire function of the circuit; or the transistors can be changed from P-type to N-type or vice versa, which is equivalent to the above-described structure in terms of achieving the objects of the embodiments of the disclosure, because the changed structure can also resolve the described technical problems and achieve the technical effects.

In addition, it shall be noted that there is no definite differences between the a drain and a source for a transistor in the field of LCD, and therefore the source of the transistors as mentioned in the embodiments of the disclosure can be the drain thereof, and the drain of the transistors can also be the source thereof. Also, a first terminal and a second terminal of a capacitor are not specifically differentiated, and such terms are merely used to clearly describe the connection relationship of the capacitor.

Another aspect of the detailed embodiments of the present disclosure also provides a driving method for driving the above-described frame scanning pixel display driving unit, and the driving method include:

during a first phase, controlling, by the driving control module according to the first frame data signal transmitted from the data writing module, the driving transistor to drive the pixel to display based on the first frame data signal; and meanwhile receiving and latching, by the data writing module, the second frame data signal;

during a second phase which is between the first phase and a third phase, pulling down a potential at a connection node between the data writing module and the driving control module to prepare for the transmission of the second frame data signal to the driving control module; and during the third phase, transmitting, by the data writing module, the second frame data signal to the driving control module.

In one example, during the first phase, the first control signal, the second control signal, the third control signal and the fourth control signal are applied so that the data writing module loads and latches a data signal output from the data signal terminal to an internal node, meanwhile the first adjusting sub-module connects the first output terminal of the first adjusting sub-module with the second voltage signal terminal in response to the first control signal; the first light-emitting control sub-module disconnects the gate of the driving transistor from the drain of the driving transistor in response to the second control signal; the second light-emitting control sub-module connects the driving transistor with the light-emitting element in response to the first control signal, the light-emitting element emits light;

during the second phase, the first control signal, the second control signal, the third control signal and the fourth control signal are applied so that the second adjusting sub-module responds to the third control signal, the output terminal of the second adjusting sub-module is connected with the third voltage signal terminal, so that a voltage between the data writing module and a common connection terminal of the first light-emitting control sub-module is equal to a voltage of the third voltage signal terminal; and during the third phase, the first control signal, the second control signal, the third control signal and the fourth control signal are applied so that the data writing module is connected with the first light-emitting control sub-module in response to the second control signal to transmit a potential of the data signal internally latched to the first light-emitting control sub-module; the first light-emitting control sub-module connects the gate and the drain of the driving transistor in response to the second control signal; meanwhile the first adjusting sub-module connects the second output terminal of the first adjusting sub-module with the second voltage signal terminal in response to the second control signal so that the light-emitting element does not emit light.

Wherein, during the first phase, the first control signal and the fourth control signal are activated, and the second control signal and the third control signal are deactivated; during the second phase, the third control signal is activated, and the first control signal, the second control signal and the fourth control signal are deactivated; and during the third phase, the first control signal, the third control signal and the fourth control signal are deactivated, and the second control signal is activated.

In the embodiment the circuit driving process is divided into three phases, but it is merely a preferred dividing manner. The disclosure is not limited to the above dividing manner. There can be a plurality of dividing manners according to different conditions and/or angles for an embodiment with equivalent circuit function, and all those dividing manners shall be within the protection scope of the disclosure.

Another aspect of the detailed embodiments of the present disclosure also provides a display apparatus which includes the above-described frame scanning pixel display driving unit, the detailed structure of the frame scanning display circuit has been described above and detailed description thereof are omitted.

According to the above descriptions, the frame scanning display circuit, the driving method thereof as well as the display apparatus according to detailed embodiments of the present disclosure can not only realize the frame scanning, but also can realize a compensation function for the IR Drop of the power source voltage drop of $V_{TH}$ and $V_{DD}$, improve display effect and reduce the power consumption for the display apparatus during the signal writing phase.

Described above are the preferred embodiments of the present disclosure. It should be noted that improvements and modifications are possible to those ordinary skilled in the related art without departing from the principle of the disclosure, and those improvements and modifications are intended to be within the protection scope of the disclosure.

What is claimed is:

1. A frame scanning pixel display driving unit, comprising a driving transistor for driving a pixel to display, a data writing module and a driving control module, wherein:

the driving control module is configured to: receive a first frame data signal transmitted from the data writing module, and control the driving transistor to drive the pixel to display based on the first frame data signal; and the data writing module is configured to: receive and latch a second frame data signal when the driving transistor drives the pixel to display based on the first frame data signal, and transmit the second frame data signal to the driving control module after the displaying of the first frame data signal is completed;

wherein the second frame data signal is a data signal of a frame next to the first frame data signal, and wherein the driving control module comprises:

a first light-emitting control sub-module, configured to receive the second frame data signal from the data writing module, and to connect a gate and a drain of the driving transistor after the displaying of the pixel is completed so that the driving transistor is connected in a diode mode;

a second light-emitting control sub-module, configured to connect the driving transistor with a light-emitting element when the driving transistor drives the pixel to display, and to disconnect the driving transistor from the light-emitting element after the displaying of the pixel is completed;

a first adjusting sub-module, configured to provide a source and the gate of the driving transistor voltage with signals enabling to turn on the driving transistor when the driving transistor drives the pixel to display, and to disconnect the voltage signals from the source and the gate of the driving transistor, respectively, when the displaying of the pixel is completed; and a second adjusting sub-module, configured to pull down a potential at a connection node between the data writing module and the first light-emitting control sub-module to prepare for the transmission of the second frame data signal to the first light-emitting control sub-module, before the data writing module transmits the second frame data signal to the first light-emitting control sub-module.

2. The frame scanning pixel display driving unit of claim 1, wherein the first adjusting sub-module, in response to a first control signal, makes the first light-emitting control sub-module to enter a first phase during which the driving transistor is driven to make the pixel to display based on the first frame data signal; the data writing module, in response to a fourth control signal, enters the first phase to receive and latch the second frame data signal; and the second light-emitting control sub-module, in response to the first control signal, enters the first phase to connect the driving transistor and the light-emitting element;

the second adjusting sub-module, in response to a third control signal, enters a second phase during which the potential at the connection node between the data writing module and the first light-emitting control sub-module is pulled down; and the data writing module, in response to the second control signal, enters a third phase during which the second frame data signal is transmitted to the driving control module; and the first light-emitting control sub-module, in response to the second control signal, enters the third phase to connect the gate of the driving transistor with the drain of the driving transistor; and the first adjusting sub-module, in response to the first control signal, disconnects the voltage signals enabling to turn on the driving transistor from the source and the gate of the driving transistor, respectively.

3. The frame scanning pixel display driving unit of claim 2, wherein the first light-emitting control sub-module comprises:

a first capacitor, wherein a first terminal of the first capacitor is connected with the gate of the driving transistor, and a second terminal of the first capacitor is connected with an output terminal of the data writing module; and a second switching transistor, wherein a gate of the second switching transistor is connected with the second control signal, a source of the second switching transistor is connected with the gate of the driving transistor, and a drain of the second switching transistor is connected with the drain of the driving transistor.

4. The frame scanning pixel display driving unit of claim 2, wherein the second light-emitting control sub-module comprises: a third switching transistor, wherein a gate of the third switching transistor is connected with the first control signal, a source of the third switching transistor is connected with the drain of the driving transistor, and a drain of the third switching transistor is connected with the light-emitting element, and wherein one terminal of the light-emitting element is connected with a first voltage signal terminal.

5. The frame scanning pixel display driving unit of claim 2, wherein the data writing module comprises:

a fifth switching transistor, wherein a gate of the fifth switching transistor is connected with the second control signal, a drain of the fifth switching transistor, which is an output terminal of the data writing module, is connected with the first light-emitting control sub-module;

a second capacitor, wherein a first terminal of the second capacitor is connected with the source of the fifth switching transistor, and a second terminal of the second capacitor is connected with a third voltage signal terminal; and a fourth switching transistor, wherein a gate of the fourth switching transistor is connected with the fourth control signal, a source of the fourth switching transistor is connected with a data signal terminal, and a drain of the fourth switching transistor is connected with a common connection terminal between the second capacitor and the fifth switching transistor.

6. The frame scanning pixel display driving unit of claim 2, wherein the first adjusting sub-module comprises:

a sixth switching transistor, wherein a source of the sixth switching transistor is connected with a third voltage signal terminal, a drain of the sixth switching transistor is connected with the source of the driving transistor, and a gate of the sixth switching transistor is connected with the second control signal;

a seventh switching transistor, wherein a source of the seventh switching transistor is connected with a second voltage signal terminal, a drain of the seventh switching transistor is connected with the drain of the sixth switching transistor, and a gate of the seventh switching transistor is connected with the first control signal; and a eighth switching transistor, wherein a source of the eighth switching transistor is connected with the second voltage signal terminal, a drain of the eighth switching transistor is connected with a common connecting terminal between the data writing module and the first light-emitting control sub-module, and a gate of the eighth switching transistor is connected with the first control signal.

7. The frame scanning pixel display driving unit of claim 2, wherein the second adjusting sub-module comprises:

a ninth switching transistor, wherein a source of the ninth switching transistor is connected with a third voltage signal terminal, a drain of the ninth switching transistor is connected with the output terminal of the data writing module, and a gate of the ninth switching transistor is connected with the third control signal.

8. The frame scanning pixel display driving unit of claim 2, wherein the fourth control signal is a gate scanning signal, and the second phase is entered after all of the first phases for each row of pixel units have been completed.

9. The frame scanning pixel display driving unit of claim 8, wherein the first adjusting sub-module and the second adjusting sub-module are connected with a column of pixel units correspondingly.

10. The frame scanning pixel display driving unit of claim 2, wherein the third voltage signal terminal is connected to the ground.

11. The frame scanning pixel display driving unit of claim 2, wherein:

the driving transistor and the transistors in the frame scanning pixel display driving unit are P-type film field effect transistors; and during the first phase, the first control signal and the fourth control signal are at a low level, and the second control signal and the third control signal are at a high level; during the second phase, the third control signal is at the low level, and the first control signal, the second control signal and the fourth control signal are at the high level; and during the third phase, the first control signal, the third control signal and the fourth control signal are at the high level, and the second control signal is at the low level.

12. A display apparatus, comprising a frame scanning pixel display driving unit, wherein the frame scanning pixel display driving unit comprises a driving transistor for driving a pixel to display, a data writing module and a driving control module, wherein:

the driving control module is configured to: receive a first frame data signal transmitted from the data writing module, and control the driving transistor to drive the pixel to display based on the first frame data signal; and the data writing module is configured to: receive and latch a second frame data signal when the driving transistor drives the pixel to display based on the first frame data signal, and transmit the second frame data signal to the driving control module after the displaying of the first frame data signal is completed;

wherein the second frame data signal is a data signal of a frame next to the first frame data signal, and wherein the driving control module comprises:

a first light-emitting control sub-module, configured to receive the second frame data signal from the data writing module, and to connect a gate and a drain of the driving transistor after the displaying of the pixel is completed so that the driving transistor is connected in a diode mode;

a second light-emitting control sub-module, configured to connect the driving transistor with a light-emitting element when the driving transistor drives the pixel to display, and to disconnect the driving transistor from the light-emitting element after the displaying of the pixel is completed;

a first adjusting sub-module, configured to provide a source and the gate of the driving transistor voltage with signals enabling to turn on the driving transistor when the driving transistor drives the pixel to display, and to disconnect the voltage signals from the source and the gate of the driving transistor, respectively, when the displaying of the pixel is completed; and a second adjusting sub-module, configured to pull down a potential at a connection node between the data writing module and the first light-emitting control sub-module to prepare for the transmission of the second frame data signal to the first light-emitting control sub-module, before the data writing module transmits the second frame data signal to the first light-emitting control sub-module.

13. The display apparatus of claim 12, wherein the first adjusting sub-module, in response to a first control signal, makes the first light-emitting control sub-module to enter a first phase during which the driving transistor is driven to make the pixel to display based on the first frame data signal; the data writing module, in response to a fourth control signal, enters the first phase to receive and latch the second frame data signal; and the second light-emitting control sub-module, in response to the first control signal, enters the first phase to connect the driving transistor and the light-emitting element;

the second adjusting sub-module, in response to a third control signal, enters a second phase during which the potential at the connection node between the data writing module and the first light-emitting control sub-module is pulled down; and the data writing module, in response to a second control signal, enters a third phase during which the second frame data signal is transmitted to the driving control module; and the first light-emitting control sub-module, in response to the second control signal, enters the third phase to connect the gate of the driving transistor with the drain of the driving transistor; and the first adjusting sub-module, in response to the first control signal, disconnects the voltage signals enabling to turn on the driving transistor from the source and the gate of the driving transistor, respectively.

14. A driving method for a frame scanning pixel display driving unit, wherein the driving method comprises:

during a first phase, controlling, by a driving control module according to a first frame data signal transmitted from a data writing module, a driving transistor to drive a pixel to display based on the first frame data signal; and meanwhile receiving and latching, by the data writing module, a second frame data signal; and during a third phase, transmitting, by the data writing module, the second frame data signal to the driving control module, wherein the frame scanning pixel display driving unit comprises a driving transistor for driving a pixel to display, a data writing module and a driving control module, wherein:

the driving control module is configured to: receive a first frame data signal transmitted from the data writing module, and control the driving transistor to drive the pixel to display based on the first frame data signal; and the data writing module is configured to: receive and latch a second frame data signal when the driving transistor drives the pixel to display based on the first frame data signal, and transmit the second frame data signal to the driving control module after the displaying of the first frame data signal is completed;

wherein the second frame data signal is a data signal of a frame next to the first frame data signal, and wherein the driving control module comprises:

a first light-emitting control sub-module, configured to receive the second frame data signal from the data writing module, and to connect a gate and a drain of the driving transistor after the displaying of the pixel is completed so that the driving transistor is connected in a diode mode;

a second light-emitting control sub-module, configured to connect the driving transistor with a light-emitting element when the driving transistor drives the pixel to display, and to disconnect the driving transistor from the light-emitting element after the displaying of the pixel is completed;

a first adjusting sub-module, configured to provide a source and the gate of the driving transistor voltage with signals enabling to turn on the driving transistor when the driving transistor drives the pixel to display, and to disconnect the voltage signals from the source and the gate of the driving transistor, respectively, when the displaying of the pixel is completed; and a second adjusting sub-module, configured to pull down a potential at a connection node between the data writing module and the first light-emitting control sub-module to prepare for the transmission of the second frame data signal to the first light-emitting control sub-module, before the data writing module transmits the second frame data signal to the first light-emitting control sub-module.

15. The driving method of claim 14, wherein the method further comprises:

a second phase which is between the first phase and the third phase, during which a potential at a connection node between the data writing module and the driving control module is pulled down to prepare for the transmission of the second frame data signal to the driving control module.

* * * * *